US008516750B2

(12) United States Patent
Liles, Jr.

(10) Patent No.: US 8,516,750 B2
(45) Date of Patent: Aug. 27, 2013

(54) SECURITY DOOR SYSTEM

(75) Inventor: William S. Liles, Jr., Corpus Christi, TX (US)

(73) Assignee: Overhead Door Corporation, Lewisville, TX (US)

( * ) Notice: Subject to any disclaimer, the term of this patent is extended or adjusted under 35 U.S.C. 154(b) by 0 days.

(21) Appl. No.: 13/013,538

(22) Filed: Jan. 25, 2011

(65) Prior Publication Data

US 2011/0113698 A1 May 19, 2011

Related U.S. Application Data

(62) Division of application No. 11/599,121, filed on Nov. 14, 2006, now Pat. No. 7,900,398.

(51) Int. Cl.
*E06B 3/00* (2006.01)

(52) U.S. Cl.
USPC ..... 49/506; 49/42; 49/25; 109/3; 109/5

(58) Field of Classification Search
USPC ..... 49/25, 42, 43, 506; 109/3, 5, 6, 109/8
See application file for complete search history.

(56) References Cited

U.S. PATENT DOCUMENTS

| | | | |
|---|---|---|---|
| 4,060,935 | A | 12/1977 | Miller et al. |
| 4,063,519 | A | 12/1977 | Pretini |
| 4,385,469 | A | 5/1983 | Scheuerpflug et al. |
| 4,475,308 | A | 10/1984 | Heise et al. |
| 4,530,183 | A | 7/1985 | Heise et al. |
| 4,534,131 | A | 8/1985 | Blackston et al. |
| 4,586,441 | A | 5/1986 | Zekich |
| 4,627,193 | A | 12/1986 | Schwarz |
| 4,628,496 | A | 12/1986 | Lee |
| 4,785,580 | A | 11/1988 | Olesen |
| 4,928,429 | A | 5/1990 | Colombo |
| RE33,407 | E | 10/1990 | Schwarz |
| 5,012,455 | A | 4/1991 | Schwarz et al. |
| 5,076,013 | A | 12/1991 | Gallenschutz et al. |
| 5,097,454 | A | 3/1992 | Schwarz et al. |
| 5,146,711 | A | 9/1992 | Gallenschutz et al. |
| 5,187,895 | A | 2/1993 | Huber |
| 5,201,142 | A | 4/1993 | Rouwendaal |
| 5,201,906 | A | 4/1993 | Schwarz et al. |
| 5,203,111 | A | 4/1993 | Huber et al. |
| 5,235,783 | A | 8/1993 | Huber et al. |

(Continued)

FOREIGN PATENT DOCUMENTS

WO WO-9304255 A1 3/1993

OTHER PUBLICATIONS

Blackhawk Active Infrared Sensor, Product Brochure, BEA, Inc., Jun. 10, 2004, 5 pages.

(Continued)

*Primary Examiner* — Jerry Redman
(74) *Attorney, Agent, or Firm* — Gardere Wynne Sewell LLP

(57) ABSTRACT

A revolving security door includes a drum defining a secure zone between door openings controlled by a revolving door disposed within the drum and wherein light curtain sensors and active infrared sensors may detect an intruder moving from a non-secure side of the doorway to the secure side and detect objects left behind in a secure zone. Methods of operation prevent persons or objects from passing from the non-secure side to the secure side of the doorway.

13 Claims, 7 Drawing Sheets

(56) References Cited

U.S. PATENT DOCUMENTS

| | | | | |
|---|---|---|---|---|
| 5,542,211 | A | 8/1996 | Colombo | |
| 5,581,944 | A | 12/1996 | Kornbrekke et al. | |
| 5,711,111 | A | 1/1998 | Nyffenegger et al. | |
| 5,878,529 | A | 3/1999 | Huber | |
| 6,073,499 | A | 6/2000 | Settles | |
| 6,076,302 | A | 6/2000 | Otto | |
| 6,370,822 | B1 | 4/2002 | Otto | |
| 6,493,991 | B1 | 12/2002 | Hamada et al. | |
| 6,678,999 | B2 | 1/2004 | Zengguang et al. | |
| 6,742,301 | B1 | 6/2004 | Schwarz | |
| 6,914,401 | B2 | 7/2005 | Semelka | |
| 6,938,371 | B2 | 9/2005 | Van Beek | |
| 6,970,085 | B2 | 11/2005 | Okabe et al. | |
| 7,021,002 | B2 | 4/2006 | Nat | |
| 7,052,390 | B2 | 5/2006 | Otto et al. | |
| 7,104,008 | B2 | 9/2006 | Yokotachi | |
| 7,382,895 | B2 | 6/2008 | Bramblet et al. | |
| 7,401,438 | B2 | 7/2008 | Wild | |
| 7,536,253 | B2 | 5/2009 | Ohba et al. | |
| 7,623,674 | B2 | 11/2009 | Nichani et al. | |
| 7,733,043 | B2 * | 6/2010 | Casella et al. | 318/280 |
| 7,900,398 | B2 * | 3/2011 | Liles, Jr. | 49/42 |
| 2002/0176607 | A1 | 11/2002 | Bond et al. | |
| 2003/0110695 | A1 | 6/2003 | Nat | |
| 2003/0136052 | A1 | 7/2003 | De Boer | |
| 2004/0006919 | A1 * | 1/2004 | Wild | 49/42 |
| 2007/0047837 | A1 | 3/2007 | Schwab et al. | |
| 2008/0028682 | A1 * | 2/2008 | Casella et al. | 49/25 |
| 2008/0244978 | A1 * | 10/2008 | Soyugenc | 49/42 |
| 2009/0200467 | A1 | 8/2009 | Gray et al. | |

OTHER PUBLICATIONS

Restriction Requirement mailed Jul. 24, 2009 for parent U.S. Appl. No. 11/599,121 (9 pages).

Non-Final Office Action mailed Nov. 17, 2009 for parent U.S. Appl. No. 11/599,121 (21 pages).

Final Rejection mailed May 26, 2010 for parent U.S. Appl. No. 11/599,121 (13 pages).

Advisory Action mailed Aug. 2, 2010 for parent U.S. Appl. No. 11/599,121 (3 pages).

Notice of Allowance mailed Oct. 25, 2010 for parent U.S. Appl. No. 11/599,121 (15 pages).

* cited by examiner

SECURITY DOOR SYSTEM

PRIORITY CLAIM

The present application is a divisional of U.S. patent application Ser. No. 11/599,121 filed Nov. 14, 2006, which has issued as U.S. Pat. No. 7,900,398, the disclosure of which is hereby incorporated by reference.

BACKGROUND OF THE INVENTION

Security door systems for both public and private buildings and facilities through which persons travel have become of increasing importance. One aspect of the protection which should be afforded by security door systems is to provide a system which can detect objects which have been left in the doorway or portal by persons attempting theft or by persons attempting to pass prohibited objects, such as firearms or explosives, through the security system.

Problems associated with the provision of a suitably operable security door system including a revolving type security door have been particularly nettlesome. For example, prior art mat type detection systems may not detect an object which does not have enough mass to activate a security mat. Moreover, certain objects can be hung on or adhered to the door or the door wings, thus also defeating mat type detection systems. Still further, the area or volume occupied by a revolving security type door presents certain problems in covering the entire security zone or area through which a prohibited object may be passed. It is to overcome the deficiencies and problems associated with proper object and person detection for a security door and a one way revolving security door, in particular, that the present invention has been developed.

SUMMARY OF THE INVENTION

The present invention provides an improved security door system operable to substantially prevent persons or objects from passing through a security portal or doorway in the prohibited direction.

The present invention also provides an improved revolving security door system which is operable to detect attempted passage by persons in the prohibited direction and attempted movement of objects through the doorway or portal in the prohibited direction.

In accordance with one important aspect of the present invention, a revolving type security door is provided which includes detection means for detecting movement of a person in the prohibited direction and detection means for detecting the presence of an object in a doorway or portal zone or area also in the prohibited direction of movement. In one embodiment of the invention an array of object detection sensors is disposed in the ceiling and floor of the doorway and provides a detection "curtain" between door entrance and exit portals or passageways. Accordingly, a person attempting to pass through or place an object in a security zone of the doorway or portal will activate an alarm and an associated control system will arrest movement of the door and effect rotation of the door in the opposite direction to evict the person from the security zone or the control system may lock the door in a position to prevent access to the object while also sounding an alarm to alert security personnel.

In accordance with a further aspect of the present invention, a security door system is provided with an array of object detection sensors for a revolving door which are arranged in a ceiling structure or adjacent the floor of the doorway within the confines of a so-called stationary drum structure and in a zone which will allow detection of the object before the object is accessible from the secure side of the doorway or portal. Still further, the security door system may include sensors arranged generally so as to detect a person or object entering the security zone of the portal and for detecting a person or object clinging to one or more of the door wings during movement of the door.

The invention further provides an improved security door system and method of operation which is adapted for operation to accept an authorized user or person passing through the doorway in one direction only, such as commonly used in airports for persons leaving the so-called secure area to enter the non-secure area. In accordance with the invention, when a violation occurs, such as when an object is placed in the doorway or portal and detection occurs, the door either stops and reverses direction or stops and is locked whereby the violating person or object is locked in a security zone and wherein only security personnel have access by way of a system controller.

Those skilled in the art will further appreciate the above-mentioned advantages and superior features of the security door system and method of the invention together with other important aspects thereof upon reading the detailed description which follows in conjunction with the drawings.

DETAILED DESCRIPTION OF THE PREFERRED EMBODIMENTS

Figure 1:
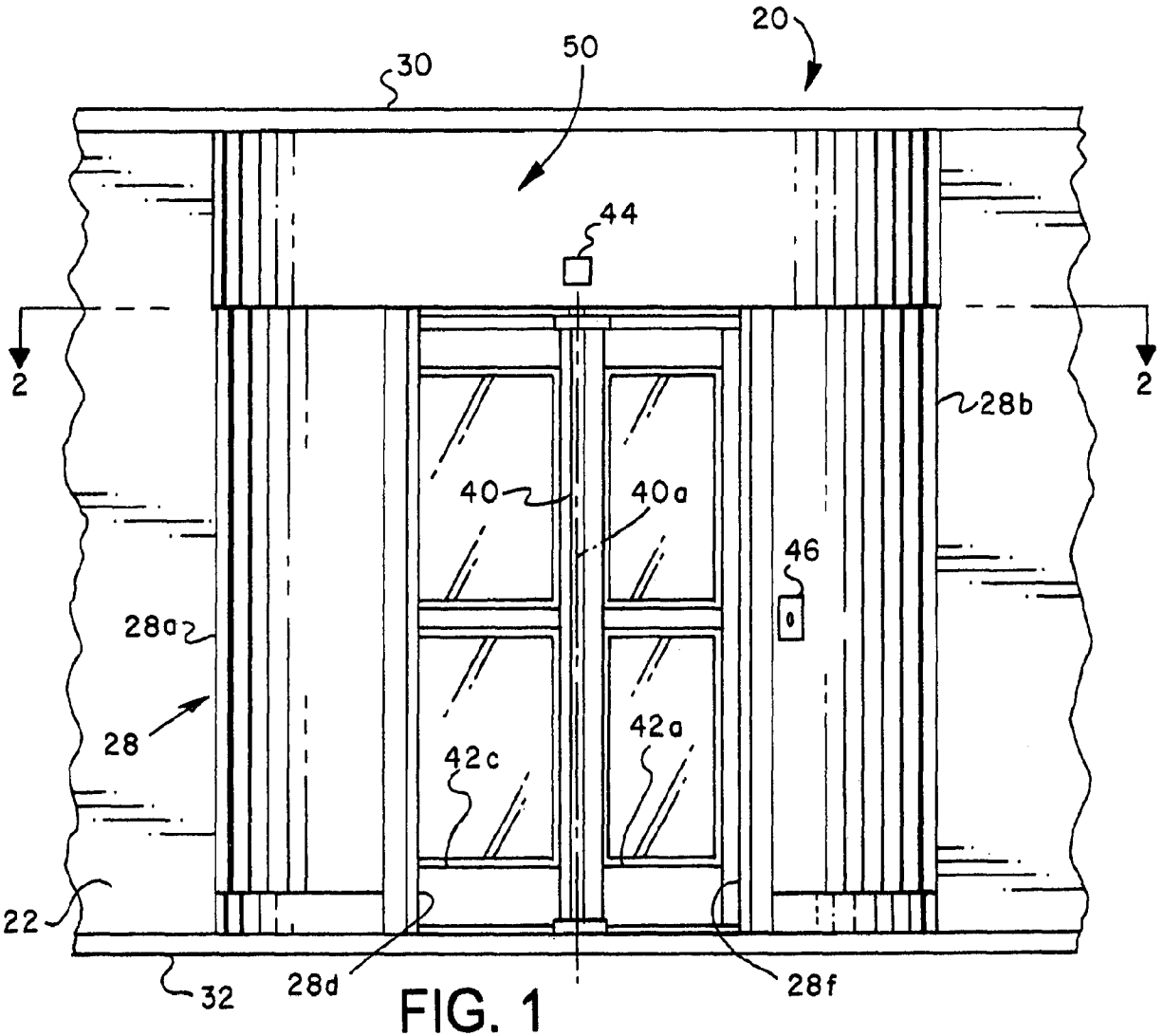
FIG. 1 is a side elevation of a revolving security door system in accordance with the present invention.

In the description which follows like elements are marked throughout the specification and drawings with the same reference numerals, respectively. The drawing figures are not necessarily to scale and certain features may be shown in somewhat generalized or schematic form in the interest of clarity and conciseness.

Figure 2:
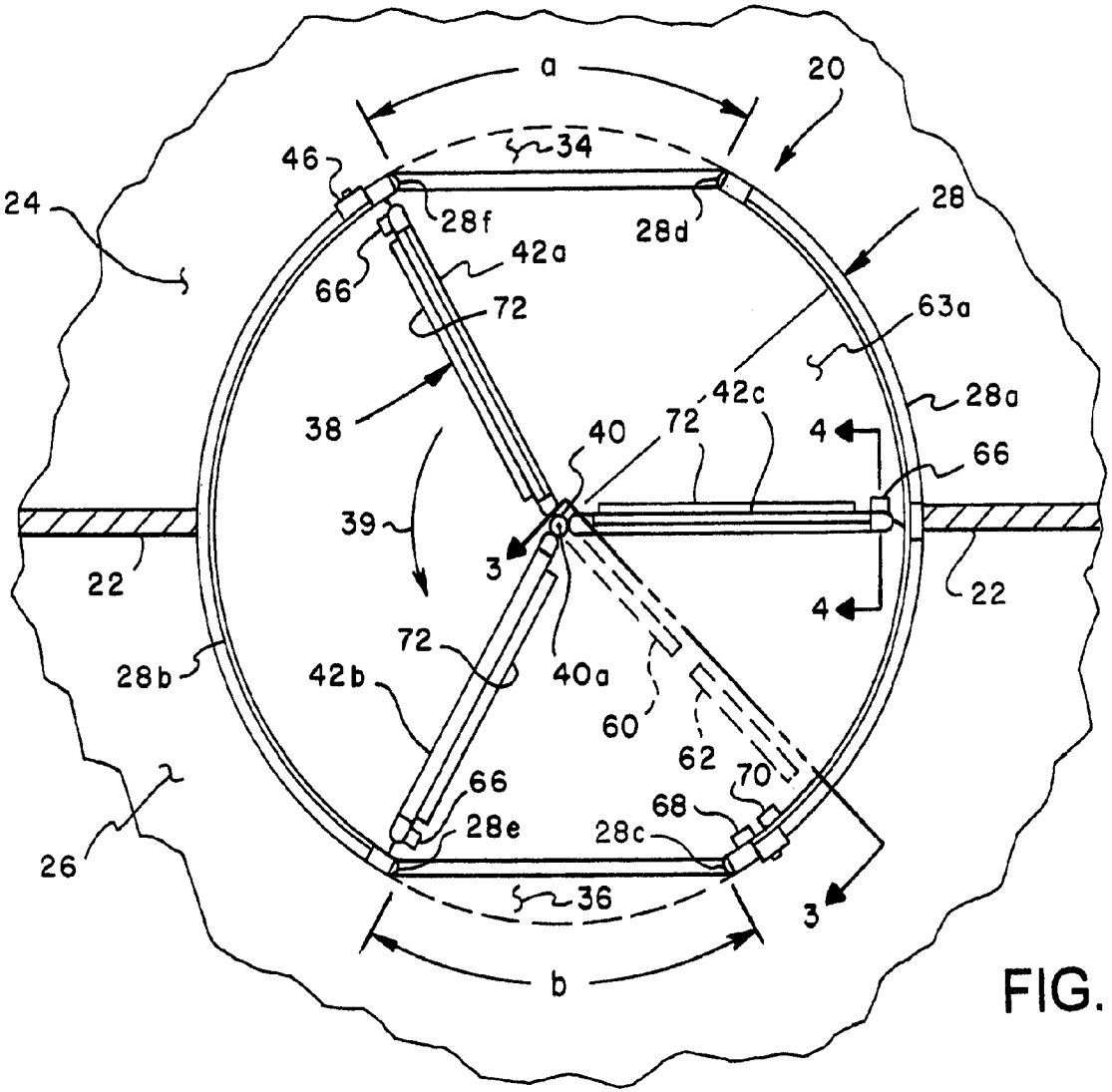
FIG. 2 is a section view taken along line 2-2 of FIG. 1.

Referring to FIGS. 1 and 2, there is illustrated an improved security door system in accordance with the invention and generally designated by the numeral 20. The door system 20 is characterized by a revolving door assembly interposed in a partition or wall 22 which isolates a so-called secure area 24 from, a non-secure area 26. Secure area 24 may, for example, be the passenger waiting lounge or "gate" area in a commercial airport wherein the non-secure area 26 is that portion of the airport terminal in which passengers and non-passengers may move without a security inspection.

Security door system 20 is characterized by a substantially cylindrical stationary drum or shell 28 of relatively conventional design except as herein indicated, which shell or drum 28 extends between a ceiling 30, FIG. 1, and a floor 32. Shell or drum 28 includes arcuate stationary wall segments 28*a* and 28*b*, FIG. 2, delimited by a secure area door opening 34 comprising an entrance and a non-secure opening 36 which is intended to be an exit opening. Within the area delimited by the shell walls 28*a* and 28*b* is disposed a revolving door 38 which includes a center shaft 40 mounted for rotation in suitable bearings, not shown, and connected to equally spaced, generally planar, radially extending door wings 42*a*, 42*b* and 42*c* dividing the internal area of the drum 28 into three substantially equal area segments. Those skilled in the art will recognize that a door with four wings, or more, may also be provided in accordance with the invention. Door 38 typically rotates in the direction of arrow 39 in FIG. 2, to permit a person walking to the opening 34 to pass to the left of the center shaft 40, viewing FIG. 2, as the door rotates, and then exiting the door system through the exit opening 36. Passenger traffic through the door system 20 will also be explained in further detail herein in accordance with two operating methods for the door system and described in conjunction with FIGS. 8 through 10 and 11 through 14 of the drawings, respectively.

As shown in FIG. 1, which is a view taken from the secure area 24, the door 38 may be activated to begin rotating upon detecting the presence of a person approaching the opening 34 by a suitable motion detector 44. Still further, the stationary drum assembly 28 is adapted to support a door slow speed switch 46 mounted on drum wall 28*b*, as shown in FIG. 1. Suitable door driving mechanism, not shown, may be mounted in an enclosure of the drum assembly 28 generally above the door 38 and generally indicated by the numeral 50 in FIG. 1. As shown in FIG. 2, the openings 34 and 36 may be delimited by arcs "a" and "b" of approximately thirty degrees each with respect to central axis 40*a* of door shaft 40, see FIGS. 1 and 2.

Figure 3:
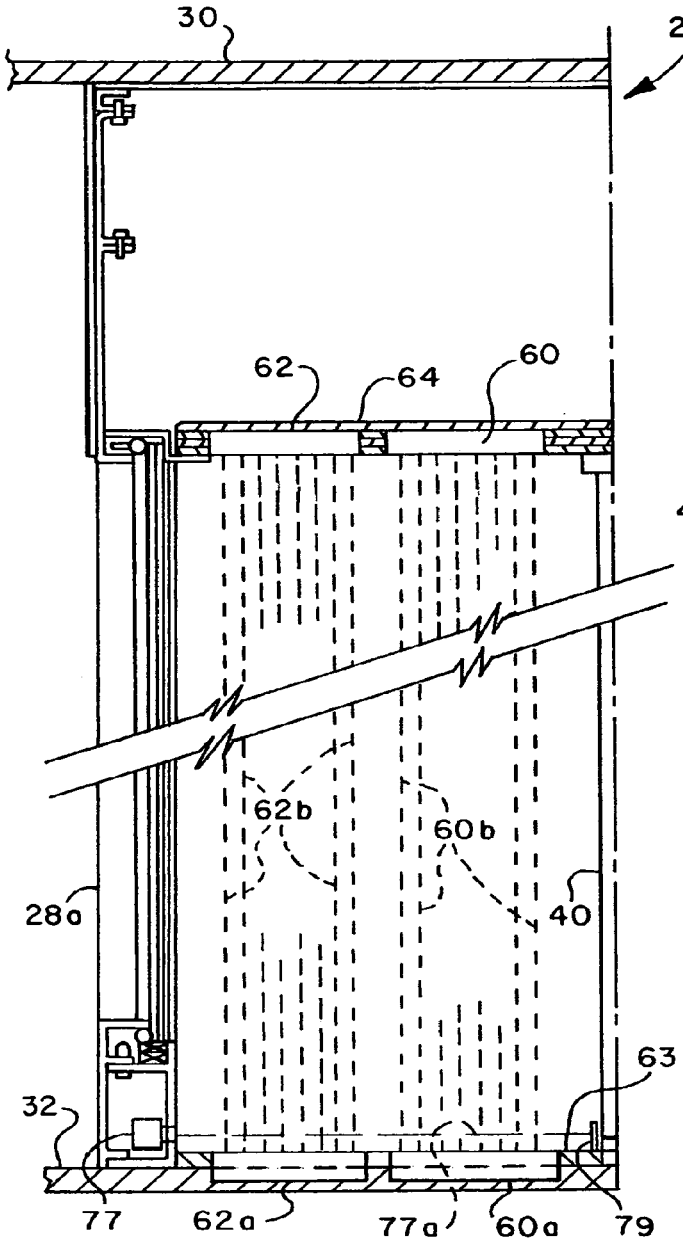
FIG. 3 is a detail section view taken generally along the line 3-3 of FIG. 2.

Security enhancing apparatus associated with the security door system 20 includes two spaced apart, so-called light curtain type sensors 60 and 62, see FIGS. 2 and 3, which are suitably mounted on or within a ceiling structure or panel 64, see FIG. 3, disposed above as a space defined by and between the drum walls 28*a* and 28*b*. Sensors 60 and 62 may be of a type commercially available, such as a so-called photoelectric light curtains system sold under the trademark GUARD-STAR by TapeSwitch Corporation, Farmingdale, N.Y. As shown in FIG. 3, the light curtain sensors 60 and 62 include transmitter units 60*a* and 62*a* which transmit, preferably, infrared beams to sensor or receiver units 60 and 62, respectively. Transmitter units 60*a* and 62*a* are mounted in suitable recesses in a conventional door floor or mat 63 disposed within the enclosure formed by the drum walls 28*a* and 28*b*.

Plural, parallel beams of infrared radiation, for example, indicated schematically by the lines 60*b* and 62*b*, are transmitted by the transmitters 60*a* and 62*a* to the light curtain sensors 60 and 62 and, if any of beams 60*b* or 62*b* are interrupted, such indicates the presence of a person or object entering a space defined between two door wings and drum wall 28*a*. Light curtain sensors 60 and 62 are arranged along a radial line just inside the enclosure edge 28*c* of drum wall 28*a*, FIG. 2. Accordingly, a person or object entering the enclosure defined between two door wings and arcuate drum wall 28*a* would be detected by sensors 60 or 62. However, the sensors 60 and 62 will also detect the presence of a door wing 42*a*, 42*b* or 42*c* as the door 38 rotates in the direction of the arrow 39 in FIG. 2. To prevent the transmission of a false signal from the sensors 60 and 62, each of the door wings 42*a*, 42*b* and 42*c* may be provided with signal generating means including a member 66 disposed on the door wing at an upper outer corner thereof, see FIGS. 2 and 4, and which is operable to move into proximity of suitable sensor means 68 mounted on the drum wall 28*a*, FIG. 2 to cause deactivation of the sensors 60 and 62 when a door wing passes through the light curtain provided by the sensors 60 and 62.

Moreover, since the location of the sensors 60 and is on a radial line from the axis 40*a* and the wings 42*a*, 42*b* and 42*c* rotate about that axis, it is advantageous to provide plural sensors, such as the sensors 60 and 62, so that they can be sequentially deactivated as the wing rotates. For example, sensor 60 will be encountered by a door wing as the door 38 rotates before such wing encounters sensor 62, and the door will pass out of the field of view of the sensor 62 before the sensor 60. Hence, a timed delay in deactivating the sensor 62 with respect to deactivation of sensor 60 may be provided for added security. This timing function may be carried out by a suitable controller, as will be explained further herein, and/or by providing second sensor means 70, FIG. 2, disposed adjacent the sensor means 68 but not activatable until after activation of the sensor means 68. In this way, the sensors 60 and 62 may be deactivated sequentially as a door wing passes through the respective light curtain fields provided by the beams 60*b* and 62*b*.

Figure 4:
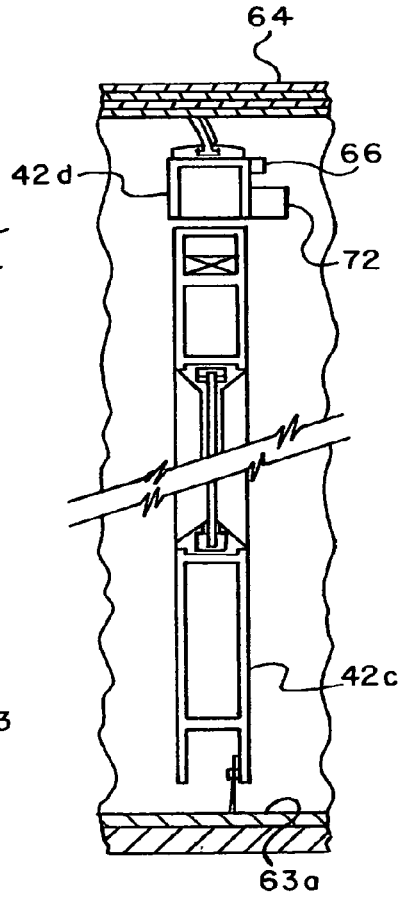
FIG. 4 is a detail section view taken generally along the line 4-4 of FIG. 2.

In addition to the sensors 60 and 62, each door wing 42*a*, 42*b* and 42*c* is provided with a suitable sensor or sensor array 72, FIG. 4, preferably mounted on the upper portion of the door wing, such as on a transverse extending frame member 42*d*, FIG. 4. Sensors 72 are operable for detecting the presence of a person or object in areas in front of the respective door wings as they rotate so as to prevent unwanted contact with a door wing by a person or object standing in the openings or ceasing to move through the portal provided by the door system 20 as the door 38 revolves. For example, if a person should slow or stop in the area within the confines of the drum 28, while the door 38 is rotating, a sensor 72 will detect the presence of the person directly ahead or in front of the door wing on which the sensor is mounted and effect arresting movement of the door via its control system.

However, certain objects left on the floor or mat 63 of the door enclosure delimited by the drum walls 28*a* and 28*b* might not be detected by sensors 72 or by a weight or pressure sensing mat part 63*a* which may comprise part of mat 63, FIG. 4. In this regard, the security door system 20 is provided with additional sensors for detecting the presence of a person or object in the enclosure or security zone disposed generally between the door edge 28*c* and the edge 28*d*, FIG. 2, which delimits one side of the opening 34. For example, a person may throw an object into the enclosure or zone between the edges 28*c* and 28*d* and shaft 40, which object could be swept along from the non-secure area 26 into the secure area 24 by a door wing, as the door 38 rotates.

Figure 5:
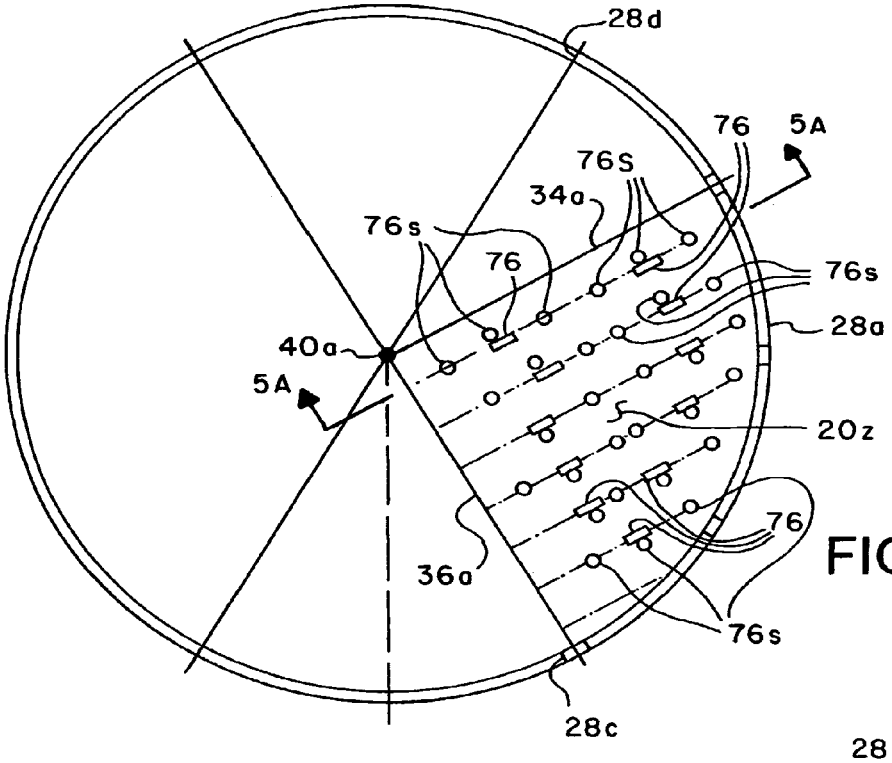
FIG. 5 is a schematic plan view illustrating the locations of object detection sensors in the security or detection zone.
Figure 5A:
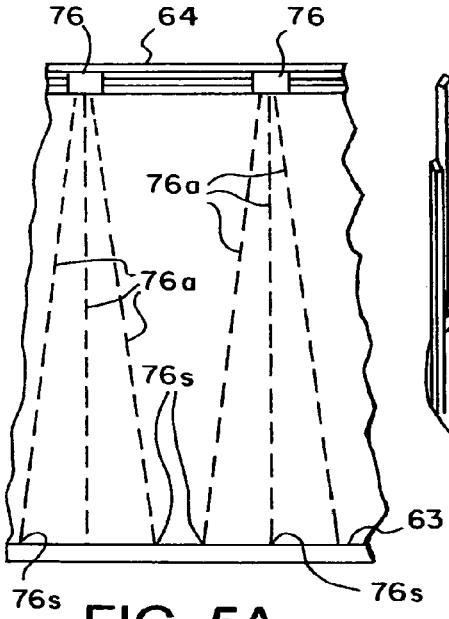
FIG. 5A is a view taken generally from line 5A-5A of FIG. 5.

In order to prevent this action from occurring, the door system 20 is advantageously provided with an array of sensors which monitor at least a major portion of the floor or mat area defined between the drum edges 28*c* and 28*d* and the center shaft 40 of the door 38. Viewing FIGS. 5 and 5A, for example, there is illustrated an array, in FIG. 5A, of object detection sensors, each designated by the numeral 76, which sensors are preferably mounted within ceiling panel 64 in somewhat the same manner as the mounting arrangement for the sensors 60 and 62, see FIG. 5A. Sensors 76 are arranged in a suitable pattern, as shown in FIG. 5, over a major portion of the zone or area 20*z* between drum edges 28*c* and 28*d*, axis 40*a* and drum wall 28*a*. Sensors 76 are disposed to project beams 76*a*, FIG. 5A, downward onto mat or floor 63 of the enclosure defined by the drum 28 and in a selected beam pattern which may be overlapping or essentially contiguous or with very little area not covered by such beams. Typically, the beams 76*a* may be arranged along a line generally whereby an arrangement of sensors 76 can provide plural generally rectangular sensing patterns on the floor or mat 63. In this way, any object having maximum dimensions of about twelve inches by twelve inches by twelve inches, for example, would be detected by one or more of the sensors 76 and which sensors would provide a signal to a controller for the door 38 to at least arrest movement of the door in a position which would prevent such an object from being accessed by a person on the secure side 24 through opening 34. The spacing of sensors 76 may be modified to provide for detecting smaller objects, if desired.

The sensors 76 may also be of a type commercially available such as so-called zone scanners available from Pepperl and Fuchs, Twinsburg, Ohio. Zone scanners or sensors available from the aforementioned company may be of a type which project multiple infrared beams generally along a line or in a rectangular pattern onto the floor or mat 63, as mentioned hereinabove, which beams are reflected back to the sensors. When a person or object interrupts a beam, the reflection of the beam from the person or object directly back to the receiver portion of the sensor may be at a lesser intensity or not reflected back to the receiver at all, which action would effect generation of an output signal by the affected sensor 76 for transmission to a controller for use in generating an alarm or other action by the door system 20, as will be explained in further detail herein. In the exemplary embodiment, shown schematically in FIG. 5, each sensor 76 projects a beam to three spots 76*s* on the mat surface of zone 20*z*, as indicated, and thus may provide a generally rectangular pattern of "spots" 76*s*. A spot 76*s* between two other spots 76*s*, for a given sensor 76, may be offset slightly from a line between the two other spots, as shown.

Accordingly, both the light curtain sensors 60 and and the array of sensors 76 are operable to detect the presence of a person attempting to move from the non-secure area 26 through opening 36 and the aforedescribed security zone of the enclosure defined by the drum 28 toward the opening 34 and the secure area 24. However, upon detection of such an event the door 38, if moving in the direction of the arrow 39 in FIG. 2, will at least stop and/or reverse its direction of rotation to force the person attempting to move to the secure area out of the door enclosure. Still further, if a person hangs on a door wing or if an object is left in a security area or zone 20*z* of the door enclosure defined between the lines 36*a* and 34*a* and the drum wall 28*a*, FIG. 5, such person or object would be detected and would cause generation of a signal which would effect rotation of the door 38 to a position as shown in FIG. 8, and then "locked" in that position to close off the area between edges 28*c* and 28*d* so that security personnel could then inspect and remove the object or interrogate such person.

Figure 6:
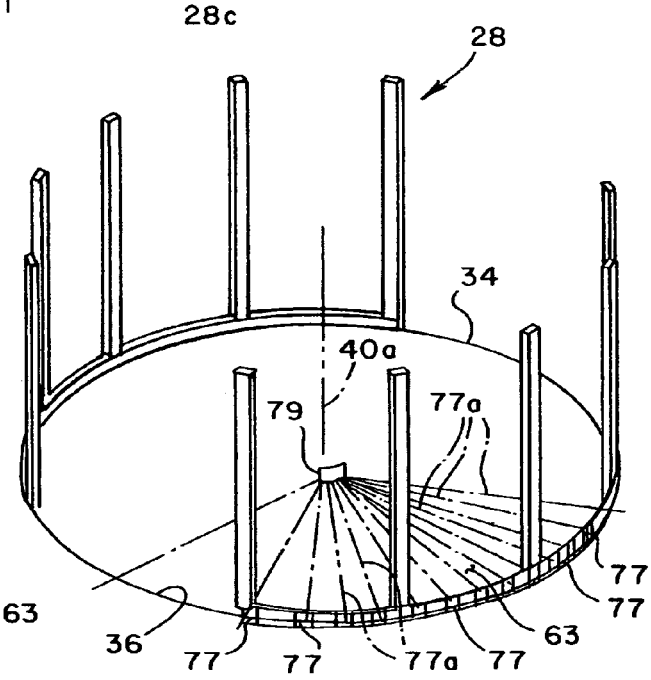
FIG. 6 is a schematic perspective view illustrating an alternate arrangement of object detection sensors for the security or detection zone.

Referring briefly to FIG. 6, an alternate embodiment of a sensor array for detection of an object residing on the floor or mat 63 in the security zone, is illustrated somewhat schematically. Sensors 76 could be replaced by an array of sensors comprising emitters or receivers 77 and/or an emitter, receiver or reflector 79 arranged generally at axis 40*a* and covering essentially the same security zone or area as covered by the array of sensors 76. Moreover, the arrangement of sensors 77, 79 is such as to provide for plural beams 77*a* which project radially, essentially, toward axis 40*a* and are reflected by sensor reflector 79 back to receiver parts of sensors 77. Sensors 77, 79 may be a type commercially available also, such as from Pepperl and Fuchs.

Figure 7:
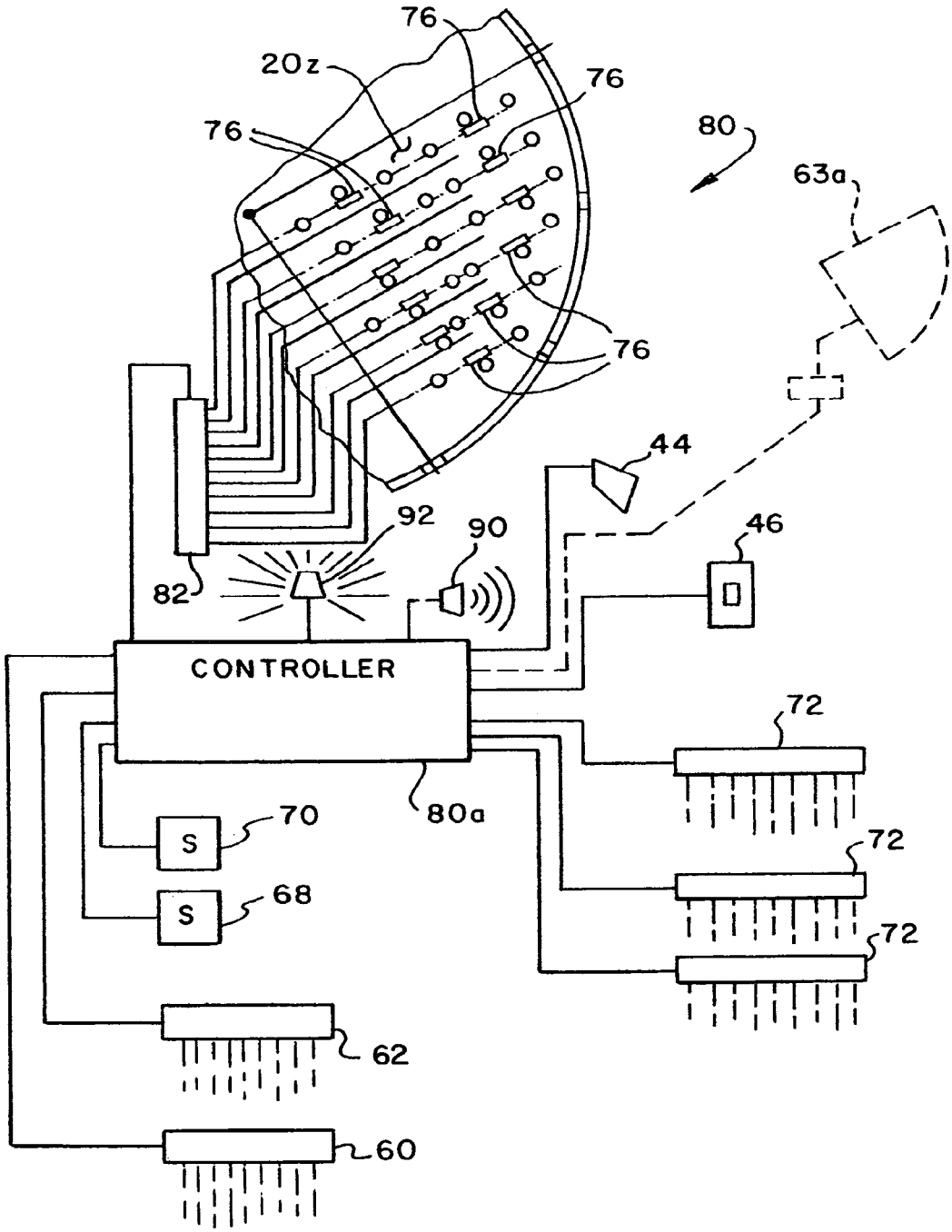
FIG. 7 is a schematic diagram illustrating certain control features of the security door system of the present invention.

Referring now to FIG. 7, there is illustrated a somewhat generalized schematic diagram of a control system 80 including a controller 80*a* for the door system 20. The components described herein in conjunction with the security or detection features of the present invention are shown connected to the controller 80*a*. Other conventional control functions used in conjunction with a commercial security revolving door, and associated control features, have been omitted in the interest of clarity and conciseness. Except as described in detail herein, the door system 20 may, for example, comprise a commercially available security revolving door system available from Horton Automatics, Corpus Christi, Tex. The schematic diagram of FIG. 7 shows sensors or receivers 60 and 62 operably connected to the controller 80*a*, and the sensor 44 and switch 46 also operably connected to the controller. Sensor means 68 and 70 are illustrated along with representative ones of the object detection sensors 76 which are shown connected to a power supply and signal receiving circuit 82 having an output connected to controller 80*a*. Still further, FIG. 7 illustrates, schematically, the so-called wing scan sensors 72, a set of which is mounted on each of the door wings 42*a*, 42*b* and 42*c*, as previously described. Lastly, the control system 80 may include a weight or pressure sensing mat or mat section 63*a* operable to provide signals to controller 80*a* and covering at least part of the security zone 20*z* of the door system 20. Accordingly, control signals from any one of the sensors 60, 62, 72, 76 and mat 63*a* may be input to the controller 80*a* along with control signals from sensor 44 and switch 46 and signals from the sensor means 68 and 70 to effect operation of the door system 20 in accordance with methods to be described further herein.

Figure 8:
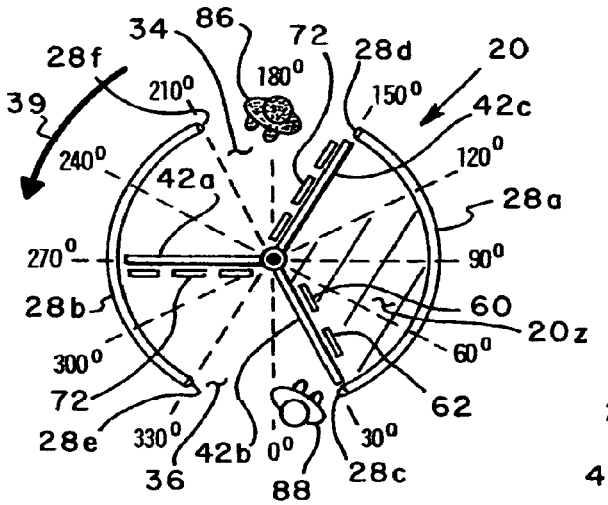
FIGS. 8, 9 and 10 are schematic diagrams illustrating one method of operating the security door system of the present invention.
Figure 9:
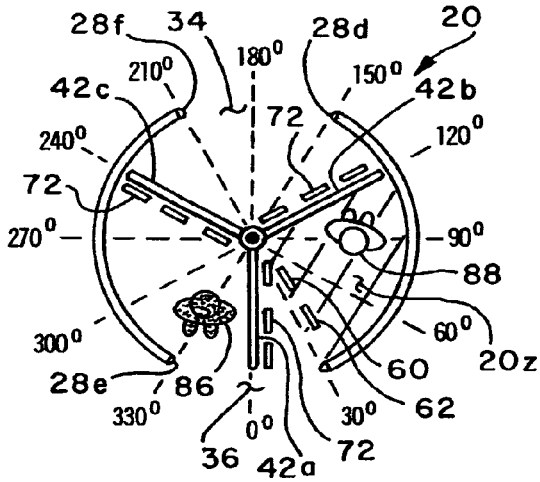
Figure 10:
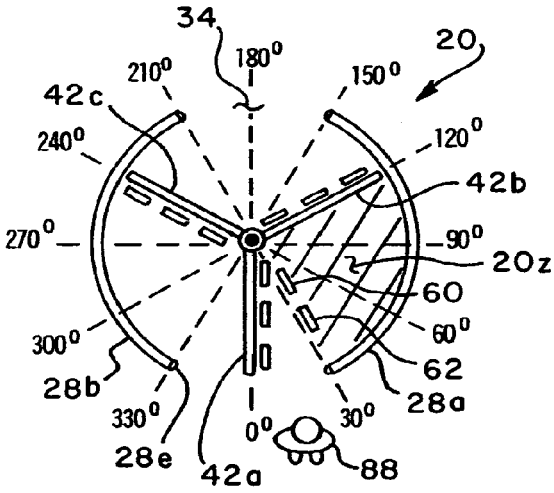

Referring now to FIGS. 8, 9 and 10, one preferred method or process for operating the door system 20 is illustrated. As shown in FIG. 8, the door 38 is normally positioned with a wing, such as wing 42*b*, blocking access to the area within the enclosure or drum 28 between the edge 28*c* and the edge 28*d* and including security zone 20*z*, indicated by diagonal hatch lines in FIG. 8 through 14. For the a particular door system 20 illustrated, the angular extent of the zone 20*z* described is preferably from a thirty degree radial to a one hundred fifty degree radial about axis 40*a* with the zero degree radial as a reference comprising a radial line centered between the drum edges 28*c* and 28*e*. In this arrangement, the one hundred eighty degree radial from the axis 40*a* is centered between the drum edges 28*d* and 28*f* in FIG. 8. Accordingly, light curtains 60 and 62, are disposed essentially along or at the thirty degree radial, as indicated, and door wing 42*c* is located on the one hundred fifty degree radial at the edge 28*d* while door wing 142*a* is disposed at the two hundred seventy degree radial. The area or security zone 20*z* within the enclosure of drum 28 between the thirty degree radial and one hundred twenty degree radial is under surveillance by the sensors 76 and, of course, the so-called wing scan sensors 72 are disposed along the leading faces of the door wings 42*a*, 42*b* and 42*c*, as illustrated.

In FIG. 8, as an authorized person 86 approaches the door opening 34, the door leaf or wing 42*a* is at the two hundred seventy degree radial and in this position, an unauthorized user may not enter a restricted area between the thirty degree and one hundred fifty degree radials. As the door 38 rotates ninety degrees to the position of FIG. 9, the unauthorized person or intruder 88 may move into the security zone 20*z*, but will be detected by the light curtains 60, 60*a*, and 62, 62*a*, and if a sensing mat, such as a mat 63*a*, is used in the security zone

20*z*, the intruder 88 would be detected by such mat also. Upon detection of the intruder 88 via the light curtain sensors 60, 62 and/or the aforementioned mat 63*a*, the door 38 will stop rotation in the position shown in FIG. 9 with wing 42*a* at the zero degree radial and wing 42*b* at the one hundred twenty degree radial. An audio and/or visual warning device, designated by the numerals 90 and 92, FIG. 7, respectively, may be energized by the controller 80*a* in this condition thereby warning the intruder 88 to exit the doorway as is indicated has been done in FIG. 10. Once the intruder 88 has cleared the security zone 20*z*, the sensors 76 are activated to scan for objects left behind in the security zone and, if the security zone is clear, the door 38 will begin normal operation and continue in response to authorized users to allow such to pass from the opening 34 to the opening 36 through the doorway formed by the door system 20.

If an object is detected inside the zone 20*z*, the door 38 will rotate until wing 42*a* is aligned with the thirty degree radial and the door 38 has the position similar to the position shown in FIG. 8. In such position door 38 will become deactivated and suitable locking mechanism will become operable to lock the door in the position of FIG. 8. Appropriate signals will be sent to security personnel or the like. In this situation, the door 38 will not respond to or become activated by an authorized user until security personnel have addressed the controller 80*a* to allow same to begin functioning normally and be responsive to sensor 44, or a keypad sensor or other device which can be used by an authorized user to initiate operation of the door system 20.

Figure 11:
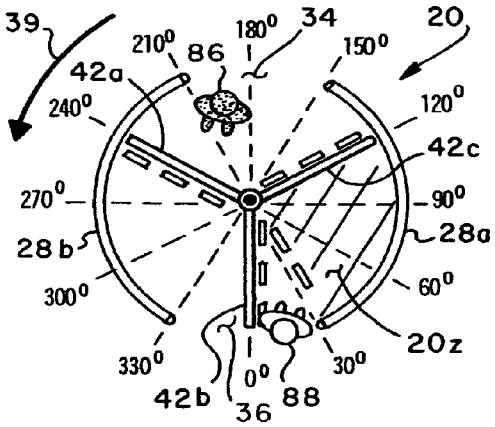
FIGS. 11, 12, 13 and 14 are schematic diagrams illustrating an alternate method of operating the security door system of the present invention.
Figure 12:
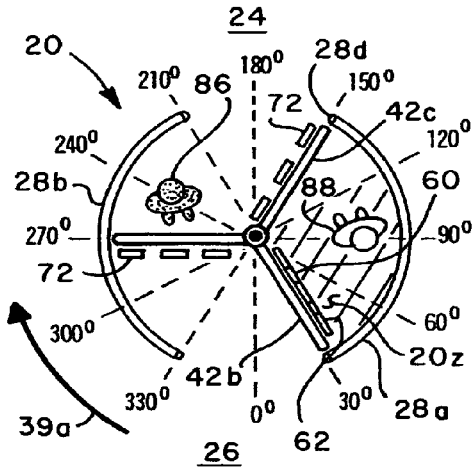
Figure 13:
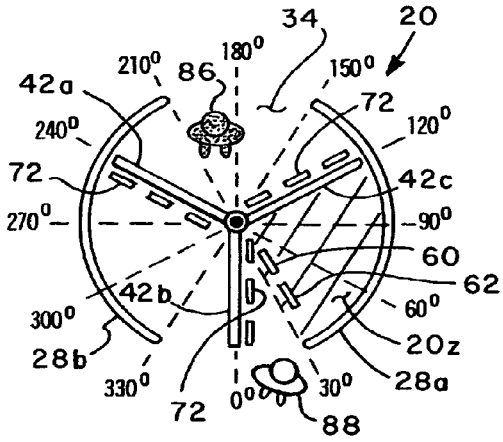
Figure 14:
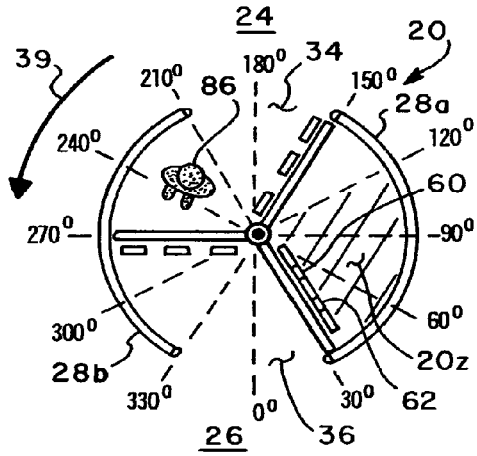

Referring now to FIGS. 11 through 14, another embodiment of a method for operating the door system 20 is illustrated and will be described as follows. As shown in FIG. 11, the door 38 may be positioned, initially, as indicated with wing 42*b*, for example at the zero degree radial thus leaving wings 42*a* and 42*c* at the two hundred forty degree and one hundred twenty degree radials, respectively. In this position of the door 38, an authorized person 86 may enter the doorway or portal through the opening 34 and either automatically or manually effect rotation of the door in the direction of arrow 39. Just prior to movement of the door 38, intruder 88 may gain access to the internal area or zone 20*z* of the enclosure between the thirty degree radial and the one hundred twenty degree radial, as indicated in FIG. 11. However, the intruder 88 will be detected by the light curtain sensors 60, 62 upon entering the aforementioned zone 20*z* between the thirty degree and one hundred twenty degree radials. Although some movement of the door 38 may occur, such would not be beyond a point where the wing 42*c* has passed the one hundred fifty degree radial and thus wing 42*c* has not moved passed the drum panel edge 28*d*. The authorized door user 86 has not gained access to the non-secure side 26 of the doorway either, as indicated in FIG. 12. In the procedure depicted in FIGS. 11 through 14, upon detection of the intruder 88 by the light curtains 60, 62 and/or a sensing mat 63*a*, the door 38 will reverse its direction of rotation, as indicated by the arrow 39*a* in FIG. 12, until the door 38 returns to the position shown in FIG. 13 which is essentially the same as the door position shown in FIG. 11. When the intruder 88 has cleared the area or zone 20*z* between the thirty degree radial and the one hundred twenty degree radial, the sensors 76 will scan for objects left within the zone and if the zone 20*z* is clear, the door will begin normal rotation to allow an authorized user 86 to pass from opening 34 to opening 36, as indicated in FIG. 14, by causing the door 38 to begin rotating again in the direction of arrow 39. At any time that a door wing 42*a*, 42*b* or 42*c* passes the light curtains 60, 60*a* and 62, 62*a*, if an object has been attached to either face of a door wing, it will be detected by the light curtains as the wing passes through the light curtains, even though the door wings themselves will effect blanking or disabling of the light curtains at the instant the wings pass through the otherwise present beam array of the light curtains. If an object is detected in a zone 20*z* or on a door wing the door 38 will stop in the position shown in FIG. 14 until security personnel retrieve the detected object and clear the controller 80*a* to begin functioning of the door 38 in a normal mode.

Preferred embodiments of a security door system and methods of operation have been described in detail herein. Conventional engineering materials and practices may be used to construct the door system 20 and the associated controls including the use of commercially available sensors for detecting objects present in the secure zone 20*z*. For example, for a three wing revolving door with a drum having openings delimited by the thirty degree radial, the one hundred fifty degree radial, the two hundred ten degree radial and the three hundred thirty degree radial, will be disposed as indicated in FIGS. 8 through 14. However, those skilled in the art will recognize that various substitutions and modifications may be made to the door system 20 and its methods of operation without departing from the scope and spirit of the appended claims.

What is claimed is:

1. A method of operating a revolving security door system, said door system comprising a substantially arcuate drum defining an enclosure and opposed first and second openings, a revolving door disposed for rotation within the enclosure and including plural radially extending door wings, a secure zone within said enclosure, first sensor means disposed generally along a radial line extending from an axis of rotation of said door to said enclosure for detecting at least one of an intruder and an object moving into said zone from said first opening on a nonsecure side of said door system, said first sensor being activated the entire time said revolving door is revolving, and second sensor means comprising plural object detection sensors for sensing the presence of an object remaining in said zone, said method comprising:

rotating said door to allow an authorized person to pass from said second opening on a secure side of said door system to said first opening;

generating a light curtain by said first sensor;

detecting with said first sensor means an intruder entering said zone;

affirmatively deactivating said first sensor means any time a door wing passes through said light curtain; and arresting movement of said door in response to detecting said intruder entering said zone and in a position of said door to allow said intruder to exit said zone through said first opening.

2. The method set forth in claim 1 including the step of:

monitoring said zone with said second sensor means to detect an object remaining in said zone.

3. The method set forth in claim 2 including the step of:

rotating said door to a position to close off said zone from said openings to prevent access to said object in said zone.

4. The method set forth in claim 2 including the step of:

arresting movement of said door in a position to prohibit a person authorized to pass through said door from moving from said second opening to said first opening in response to sensing said object in said zone.

5. The method set forth in claim 2 including the step of:

providing said first sensor means as plural sensors arranged along said radial line and emitting radiation beams within said enclosure.

6. The method set forth in claim 2 including the step of:

providing control means for controlling operation of said door in response to at least one of said first and said second sensor means.

7. The method set forth in claim 2 including the step of:

providing said second sensor means as active radiation emitting sensors disposed in a pattern to detect an object disposed in said zone.

8. The method set forth in claim 2 including:

providing a sensor mat disposed in said zone for sensing at least one of a person and object disposed on said mat.

9. The method set forth in claim 1, wherein said affirmatively deactivating of said first sensor means is effected by the generation of a signal from a member disposed on said door wing.

10. A method of operating a revolving security door system, said door system comprising a substantially arcuate drum defining an enclosure and opposed first and second openings, a revolving door disposed for rotation within the enclosure and including plural radially extending door wings, a secure zone within said enclosure, a first sensor including a transmitter and a receiver, the first sensor being disposed generally along a radial line extending from an axis of rotation of said door to said enclosure for detecting at least one of an intruder and an object moving into said zone from said first opening on a non-secure side of said door system and plural object detection sensors for sensing the presence of an object remaining in said zone, said method comprising:

rotating said door to allow an authorized person to pass from said second opening on a secure side of said door system to said first opening;

transmitting radiation radially from said transmitter toward a reflector positioned at said axis of rotation;

reflecting said radiation from the reflector toward said receiver to detect with said first sensor an intruder entering said zone; and arresting movement of said door in response to detecting said intruder entering said zone and being in a position of said door to allow said intruder to exit said zone through said first opening.

11. The method set forth in claim 10 wherein said first sensor is comprises a light curtain sensor.

12. A method of operating a revolving security door system, said door system comprising a substantially arcuate drum defining an enclosure and opposed first and second openings, a revolving door disposed for rotation within the enclosure and including plural radially extending door wings, a secure zone within said enclosure, a light curtain sensor including a transmitter and a receiver, the light curtain sensor being disposed generally along a radial line extending from an axis of rotation of said door to said enclosure for detecting at least one of an intruder and an object moving into said zone from said first opening on a non-secure side of said door system and plural object detection sensors for sensing the presence of an object remaining in said zone, said method comprising:

rotating said door to allow an authorized person to pass from said second opening on a secure side of said door system to said first opening;

transmitting radiation radially from said transmitter toward said axis of rotation to said receiver to detect with said light curtain sensor an intruder entering said zone; and generating a signal from a member disposed on said door wing to affirmatively deactivate said light curtain sensor when a door wing would otherwise be sensed by said light curtain sensor as said door rotates.

13. The method set forth in claim 12 including the step of:

arresting movement of said door in response to detecting said intruder entering said zone and in a position of said door to allow said intruder to exit said zone through said first opening.

* * * * *